US005161787A

United States Patent [19]

Hobday

[11] Patent Number: 5,161,787

[45] Date of Patent: Nov. 10, 1992

[54] CLAMPING DEVICE

[76] Inventor: Harold W. Hobday, 10530 Armo Rd., Galt, Calif. 95632

[21] Appl. No.: 789,296

[22] Filed: Nov. 8, 1991

[51] Int. Cl.[5] ..... B25B 1/02

[52] U.S. Cl. ..... 269/6; 269/166; 269/170; 269/249

[58] Field of Search ..... 269/3, 6, 143, 165-171.5, 269/249; 29/270, 278

[56] References Cited

U.S. PATENT DOCUMENTS

| | | | |
|---|---|---|---|
| 2,472,022 | 5/1949 | Neal | 269/166 |
| 2,731,176 | 1/1956 | Crewe | 222/326 |
| 2,732,102 | 1/1956 | Ekins | 222/327 |
| 4,176,830 | 12/1979 | Islay | 269/6 |
| 4,220,322 | 9/1980 | Hobday | 269/6 |
| 4,291,868 | 9/1981 | Giles | 269/170 |
| 4,330,070 | 5/1982 | Doubleday | 222/43 |
| 4,436,294 | 3/1984 | Irelan | 269/6 |
| 4,681,524 | 7/1987 | Ikeda | 425/376 R |
| 4,753,427 | 6/1988 | Lodrick, Sr. | 269/185 |
| 4,874,155 | 10/1989 | Goul | 269/6 |
| 4,893,801 | 1/1990 | Flinn | 269/6 |
| 4,925,169 | 5/1990 | Lodrick, Sr. | 264/185 |
| 4,926,722 | 5/1990 | Sorensen | 81/487 |
| 4,989,847 | 2/1991 | Chapman | 269/170 |
| 5,005,449 | 4/1991 | Sorensen | 81/152 |
| 5,009,134 | 4/1991 | Sorensen | 81/487 |
| 5,076,522 | 12/1991 | Challis | 269/6 |

*Primary Examiner*—J. J. Swann

*Attorney, Agent, or Firm*—Oldham, Oldham & Wilson Co.

[57] ABSTRACT

An improved C-clamp has a clamp body and a detachable setting mechanism. The clamp body has inner and outer legs with a hollow bore in the inner leg to allow passage of a stem having a work-engaging pad on its end therethrough toward an aligned fixed work pad on the outer leg. The setting mechanism for advancing the stem has a hand lever and hand grip that act in concert upon manual squeezing to step-by-step advance the stem. The setting mechanism removably attaches to the clamp body by a spring-biased lever that grips attachment pins on the body. A latch lever positioned on the inner leg of the clamp body causes a retaining lever to grip the stem when the latch lever is closed and to allow the stem to move freely when the latch lever is open.

10 Claims, 4 Drawing Sheets

CLAMPING DEVICE

The present invention relates to hand tools and in particular to a C-clamp having a setting mechanism that permits the clamp to be engaged with a workpiece in a one-hand manner. More particularly, the invention relates to an improved one-hand C-clamp wherein the setting mechanism is a hand grip unit that is removably attachable to the clamp body so that the same setting mechanism may be used with a plurality of clamp bodies.

BACKGROUND ART

The inventor is the inventor of U.S. Pat. 4,220,322, issued Sep. 2, 1980, entitled "One-Hand Operated, Ratchet-Actuated, Quick-Set C-Clamp." Since the issue of that patent, several patents have issued for similar devices. These include: U.S. Pat. No. 4,436,294 to Irelan (Mar. 13, 1984); U.S. Pat. No. 4,753,427 to Lodrick, Sr. (Jun. 28, 1988 ); U.S. Pat. No. 4,874,155 to Goul (Oct. 17, 1989); U.S. Pat. No. 4,893,801 to Flinn (Jan. 16, 1990); U.S. Pat. No. 4,925,169 to Lodrick, Sr. (May 15, 1990); U.S. Pat. No. 4,926,722 to Sorensen (May 22, 1990); U.S. Pat. No. 4,989,847 to Chapman (Feb. 5, 1991); U.S. Pat. No. 5,005,449 to Sorensen (Apr. 9, 1991); and U.S. Pat. No. 5,009,134 to Sorensen (Apr. 23, 1991). Neither the inventor's '322 patent nor any of the subsequent patents issued have been able to successfully teach a solution to one of the disadvantages of a one-hand clamp device: the cost and manufacturing complexity involved in constructing a C-clamp with an integral one-hand setting mechanism. The present invention now teaches a clamp device in which the setting mechanism is separable from the clamp body such that a single setting mechanism may be utilized in conjunction with a variety of clamp bodies, even clamp bodies of various sizes.

SUMMARY OF THE INVENTION

An object of the invention is to provide a C-clamp having easy one-hand operability, but wherein the setting mechanism is detachable from the clamp body, so that a single setting mechanism may be used with a plurality of clamp bodies, even clamp bodies of different sizes.

This and other objects of the invention are achieved by an improved C-clamp in which the clamp body is separate from a detachable setting mechanism. The clamp body has inner and outer legs with a hollow bore in the inner leg to allow passage of a stem having a work-engaging pad on its end therethrough toward an aligned fixed work pad on the outer leg. The setting mechanism for advancing the stem has a hand lever and hand grip that act in concert upon manual squeezing to step-by-step advance the stem. The setting mechanism removably attaches to the clamp body by a spring-biased lever that grips attachment pins on the body. A latch lever positioned on the inner leg of the clamp body causes a retaining lever to grip the stem when the latch lever is closed and to allow the stem to move freely when the latch lever is open.

BRIEF DESCRIPTION OF THE DRAWINGS

Understanding of the present invention will be best achieved by reference to the drawings presented herewith, wherein identical reference numerals refer to identical parts, and in which.

DETAILED DESCRIPTION OF THE DRAWINGS

In the conventional C-Clamp (not shown) which was known prior to the Hobday '322 patent, a C-shaped normally upwardly opening body would be provided with an outer leg and an inner leg, the upper end of the outer leg having a fixed, rearwardly-facing work-engaging pad and the inner leg having a stem threaded through a bore therein, the front end of the threaded stem having a work-engaging pad on it so that when a workpiece is engaged against the work-engaging pad on the outer leg and the stem is rotated manually, causing a forward motion of the work-engaging pad on the forward end of the threaded stem. The alignment of the respective work-engaging pad enables clamping or grasping of the workpiece. The prior art improvements to this type of C-clamp, including the inventor's '322 patent and others, teach a variety of hand grip mechanisms for setting the work-engaging pads against the workpiece with the use of only one hand of the user. The Hobday '322 patent and its progeny all disclose the use of a hand grip device for providing the function of the rotatable threaded stem, that is, the advancing of the work-engaging pad on the stem towards the work-engaging pad on the outer leg (actually, the latest Sorensen '134 patent teaches a hand mechanism that may be used to drive the work-engaging pads in opposite directions, but it also includes the option of driving the work-engaging pads towards each other.)

Although these improved C-clamps share the increased ease of application over the prior art conventional C-clamp with a threaded stem, it is believed that none of the inventions have achieved proper recognition or acceptance in the market place, due to the additional complexity, weight and manufacturing cost that is associated with integrating a hand-lever mechanism onto the clamp body. The inventor believes that the invention taught herein provides exactly the solution to these problems.

Figures 1, 2:
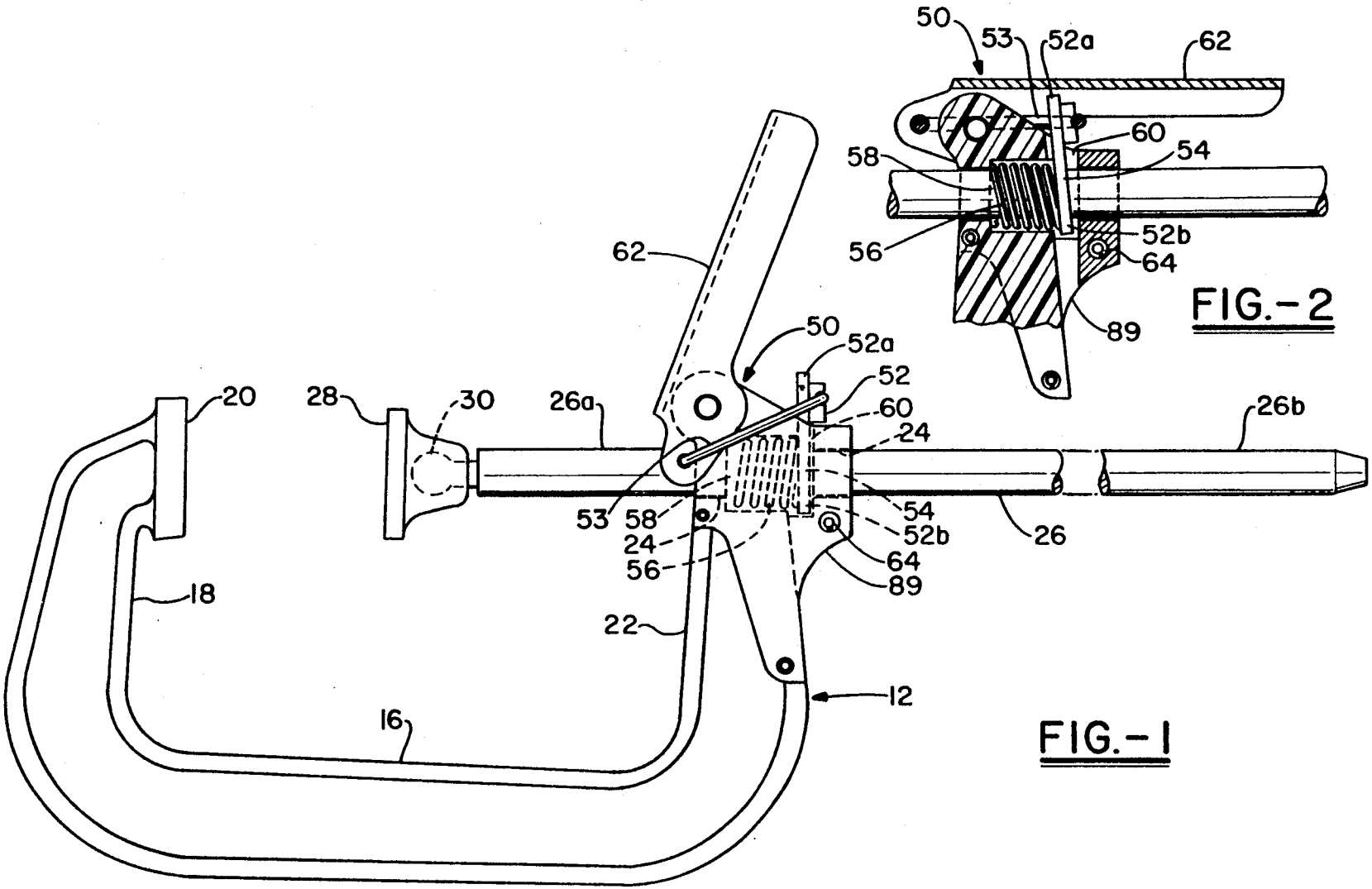
FIG. 1 shows an elevational view of the clamp unit of the present invention, said clamp unit detached from the setting unit of the present invention.
FIG. 2 shows a further elevational detail section of a portion of the clamp unit shown in FIG. 1.
Figure 6:
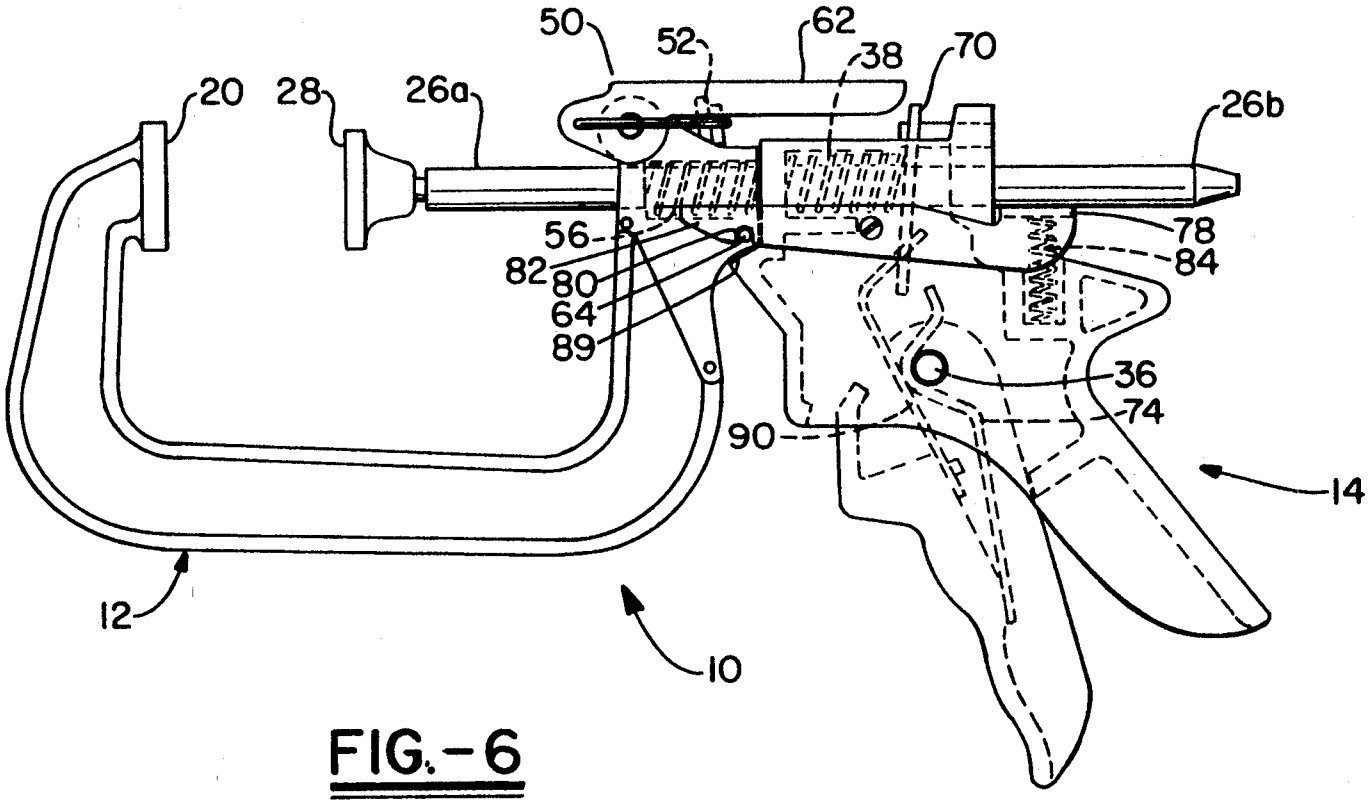
FIG. 6 shows the clamp unit and setting unit in operative engagement.

Attention is now directed to FIG. 6, wherein an improved C-clamp 10 is illustrated. The clamp 10 generally is comprised of two portions: a clamp unit 12, and a setting mechanism or unit 14, which are shown in operative engagement later reference to FIG. 6 will describe other pertinent features. As better illustrated in FIGURE 1, where the elevational view illustrates the clamp unit 12 completely detached from the setting unit 14, the clamp unit 12 comprises a normally upwardly opening C-shaped body 16 provided at the upper end of its outer leg 18 with a fixed, rearwardly-facing work-engaging pad 20. The inner leg 22 of the body 16 has a forward facing bore 24 at its upper end, the bore passing through the upper end of the inner leg 22 so that it is in alignment with the outer leg, particularly the work-engaging pad 20 affixed to said outer leg 18. This bore 24 is coaxial with the longitudinal working axis of the clamp unit.

A smooth rod-like stem 26 is slidingly engaged with a close running fit in the bore 24 and each end of the stem projects outwardly from the respective ends of the bore 24 so that the stem 26 has a forwardly facing end 26*a*, and a rearwardly facing end 26*b*. At the forward end 26*a*, the stem 26 is fitted with a forwardly facing work-engaging pad 28, which is preferably swivelly fitted at the forward end 26*a* by a conventional ball and socket unit 30. The work-engaging pad 28 on stem 26 is positioned into alignment with the fixed work-engaging pad 20 and the length of the stem 26 is at least so long as to allow the registration of the respective work-engaging pads 20 and 28 upon each other while the rearward end 26*b* of the stem still projects from the bore 24 far enough to allow attachment of the setting mechanism 14.

The stem 26 is formed from a smooth rod of material and has no teeth or other longitudinal projections along its length. The rearward end 26*b* may be chamfered or beveled so as to aid the insertion of the stem into the setting unit, as will be better described below.

At the upper end of the inner leg 22, a means 50 for releasably holding the stem from movement rearwardly relative to the body 16 is provided. To understand the preferred embodiment of this holding means 50, reference should be had to FIGS. 1 and 2, the latter FIGURE revealing the holding means portion of the clamp unit 12 in detailed sectional view. In this preferred embodiment of the invention as illustrated, the means 50 for releasably holding the stem comprises a retaining lever plate 52 having first and second ends 52*a*, 52*b* with a bore 54 through the plate towards the second end. This bore 54 is circular and provides a close running fit with the stem 26 when the plate 52 is positioned perpendicular to the longitudinal axis of the stem 26. The retaining lever plate 52 is biased into a generally perpendicular position with relation to the stem 26 by a stiff, normally unloaded helical spring 56 located concentrically about the stem. The spring 56 is seated in a box-like structure atop the free end of the inner leg 22 such that the first end of the spring rest upon the front wall 58 of the box-like structure and the rear wall 60 of the box-like structure provides a perpendicular surface upon which the retaining lever plate 52 is held when the second end of the spring 56 bears upon the plate 52. The bore 24 through the inner leg 22 effectively provides co-axial circular apertures in the front and rear walls 58 and 60. By means of a latch lever 62 communicated with the first end 52*a* of the retaining plate by a wire bail 53 that surrounds the first end 52*a*, the angularity of the plate with relation to the longitudinal axis of the stem 26 may be altered. When this occurs, the aspect of the bore 54 in the plate 52 becomes elliptical with regard to the stem 26 and the previously close running fit becomes a frictional engagement of the stem. When the latch lever 62 is positioned as in FIG. 1, the retaining lever plate 52 is perpendicular to the axis of the stem 26 and stem motion in either direction is allowed; when the latch lever 62 is closed as in FIG. 2, the retaining lever plate 52 is angularly positioned with relation to the stem 26 and pulled forwardly away from wall 54, the angular relationship is provided by the uneven bias on plate 52 at the first end 52*a* by the communication with latch lever 62. Configured in this manner, the stem 26 can be moved only forward.

Also affixed to the upper end of inner leg 22 is a means for attaching the setting mechanism 14 to the clamping unit 12. In the particular preferred embodiment illustrated in the drawings, the means for attaching that is affixed to the upper leg 22 consists of a pair of pins 64 extending outwardly on either side of the upper leg 22 in a perpendicular manner to both the surfaces of the upper leg and the longitudinal axis of the stem 26. These pins 64 will engage the setting unit 14 as illustrated in FIG. 6.

Figure 3:
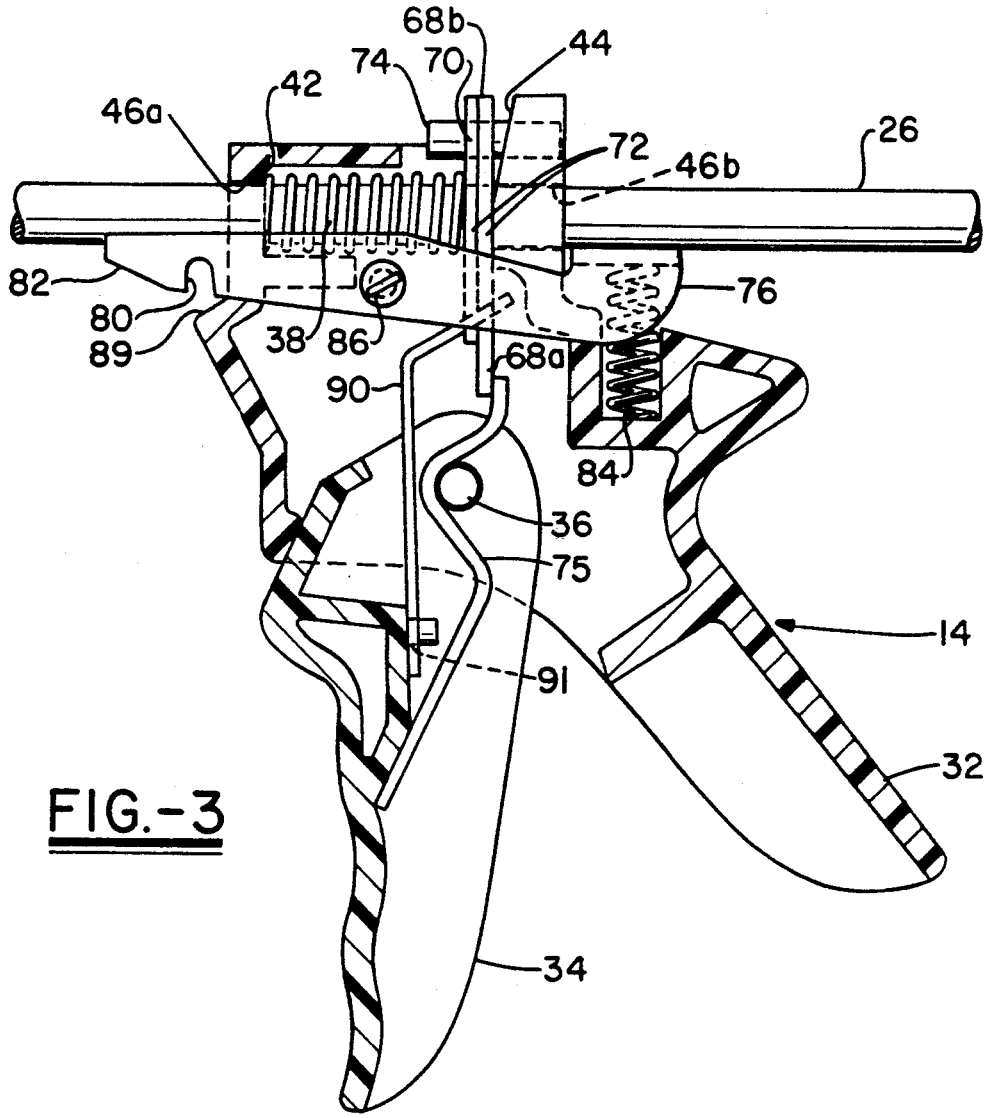
FIG. 3 shows a sectional elevational view of the setting mechanism of the present invention separate from the clamp unit.
Figure 4:
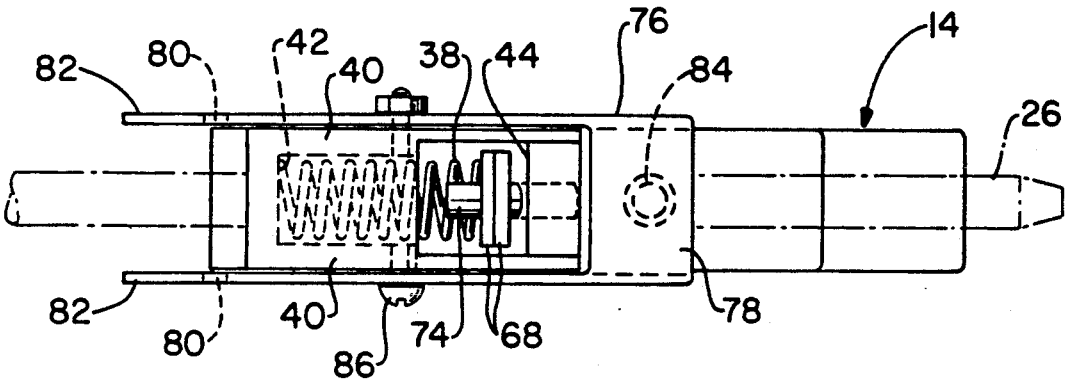
FIG. 4 shows a top view of the setting unit of FIG. 3.

Attention is next directed to FIGS. 3 and 4, where the setting unit 14 is disclosed in more detail. This unit is designed to be removably attachable to the clamp unit 12, and FIGS. 3 and 4 show it in a detached state. The setting unit 14 includes a hand grip 32 and a hand lever 34 forwardly thereof; the hand lever 34 being transversely pivoted adjacent but short of its upper end on the hand grip at a point 36 as shown in the FIGURE. In this manner, the user, by grasping the setting mechanism 14 and squeezing thereon causes the hand lever 34 to swing toward the hand grip 32 and against the bias of a stiff, normally unloaded, helical spring 38 which, by communication through plate 90, normally holds hand grip 32 and lever 34 in expanded or inverted V-shaped spaced apart relation.

The upper portion of the setting mechanism 14 is integral with the hand grip 32 such that the setting mechanism includes transversely spaced side walls 40, a front end wall 42 and a rear end wall 44. The end walls 42 and 44 each have aligned circular holes 46*a* and 46*b*, respectively. Positioned concentrically between holes 46*a* and 46*b* is a short stiff, normally substantially unloaded helical spring 38 through which the stem 26 may be fitted. Spring 38 is closely surrounded by walls 40, 42 and 44 along at least a portion of its length to retain it in position when setting mechanism 14 is not attached to clamp unit 12. At the forward side of the rear wall are positioned a pair of advancing lever plates 68 having a lower end 68*a* and an upper end 68*b*. There are a pair of apertures 70, 72 in the plates, the first aperture 70 being near the upper end 68*b* so that a pin 74 can fit through the plates 68 at aperture 70 to hold plates 68 in place when setting mechanism 14 is not attached to clamp unit 12. The second aperture 72 is positioned toward the middle of the advancing lever plate 68, this latter aperture 72 being in close running fit with the stem 26 so that the stem will fit through the aperture 72 when the plate 68 is substantially positioned perpendicular to the longitudinal axis of the stem 26, but so that angular movement of the plate 68 with relation to the longitudinal axis of the stem 26 will cause the periphery of the aperture to frictionally engage the stem.

In FIG. 3 the formed plate 90 and the formed plate 74 act together, with the rotation of the hand lever 34 acting to force plate 68 forward into a cramped position and thus urge stem 26 forward with each stroke. Formed plate 75 bears against plate 68 at its upper end, against pin 36 near its middle and against lever 34 at its lower end. Formed plate 90 has a rectangular cutout at its upper end to surround plate 68 and near its middle bears against plate 75. A slot 91 near the lower end of plate 90 anchors it to lever 34 so that the movement of hand lever 34 moves plate 90. Plate 90 is relatively flexible, so that it has only sufficient stiffness to advance plate 68 until resistance is encountered, at which point it yields somewhat. This provides a long quick stroke and enhances usefulness of the clamp. When resistance is encountered, plate 90 yields and the shorter, stiffer (relative to plate 90) plate 74 comes into action. Being shorter with respect to plate 90, plate 74 has increased leverage making it possible to have a quick closing clamp, but one that holds tightly as well. Plates 74 and 90 coact such that the former is short and stiff and the latter is long and limber, but the combined stiffness is not enough to impose undue stress on the clamp mechanism. When clamp unit 12 and setting mechanism 14 are latched together and latch lever 62 closed, repeated squeezes of hand lever 34 will close and tighten the clamp against a chosen workpiece. After setting the workpiece, setting unit 14 may be removed and placed on another clamp unit 12. When the clamp unit is to be removed from the workpiece, it is not necessary to reattach the setting mechanism 14 to do so. Simple opening of latch lever 62 and manual withdrawal of stem 26 will suffice.

A thumb lever 76 having a thumb plate 78 at its rear end and a pair of grasping notches 80, one on each side of the bifurcated second end 82 of the thumb lever 76, is positioned astride the upper portion of the setting mechanism 14 and under the holes 46*a* and 46*b*. A biasing spring 84 to bias the rear end 78 the thumb lever 76 upwardly is positioned directly below the thumb plate 78. An intermediate fulcrum screw 86 is positioned approximately halfway between the thumb plate and the grasping notches 80. These grasping notches are for engagement of pins 64 that are positioned on the clamp unit 12.

Directing attention then to FIG. 4, the bifurcated or clevis-shaped nature of the thumb lever 76 is shown with the corresponding notches 80 being positioned on each side of the setting mechanism 14.

Figure 5:
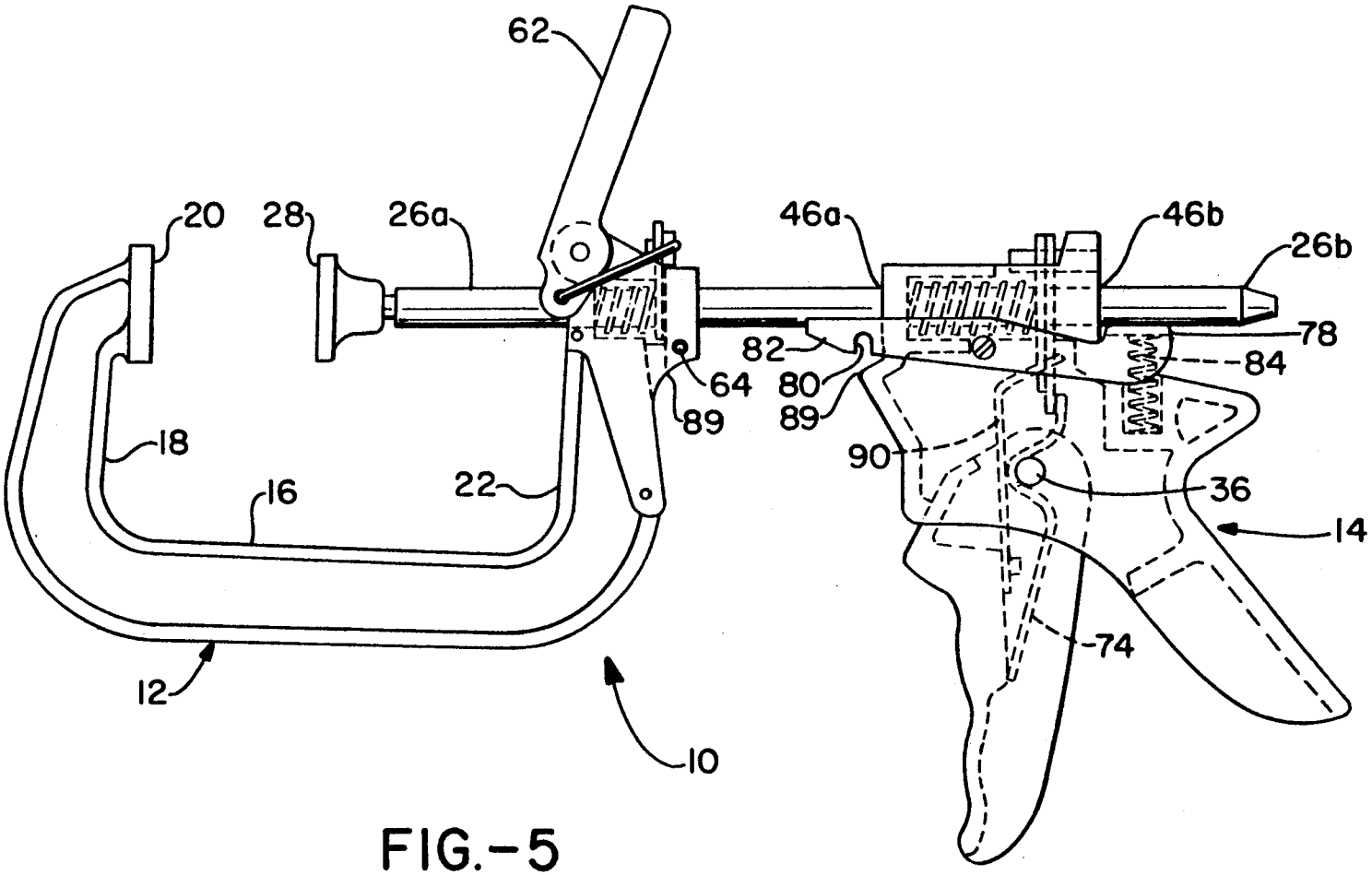
FIG. 5 shows the setting unit of the present invention being operatively engaged onto the clamp unit, in elevational view.

The juxtaposition of the setting mechanism 14 and the clamping unit 12 is shown in FIGS. 5 and 6. In FIG. 5, the stem 26 has been inserted through the holes 46*a* and 46*b* respectively so that the setting mechanism 14 slides on the stem toward the clamp unit 12. The latch lever 62 is shown as being open, but it could be closed at this point in the operation. As the setting mechanism 14 rides upon the stem 26 and approaches the clamp unit 12, the ramped second ends 82 of the thumb lever mechanism causes the thumb lever to be depressed against the upward urging of the spring biasing means 84 and the pin engaging notches 80 to engage the pins 64. This mechanism may, of course, be facilitated by the further depression of the thumb plate 78 to assist the grasping pins 64 in being engaged. Once engaged as shown in FIG. 6, the C-clamp unit of the present invention 10 is ready for operation. It may be preferred to have corresponding angular engaging surfaces 89 on the clamp unit 12 and setting unit 14 so that the respective units are properly positioned and to minimize rotation about the stem axis.

Once the workpiece is secured, the setting mechanism 14 may be removed by the disengagement of the notches 80 from the holding pins 64 by depressing the thumb lever 78 against the upward urging of the bias spring 84 and the rearward pulling of the setting mechanism 14 off the stem 26.

It will also be appreciated from this description that the setting mechanism 14 may be used with a variety of different C-clamps, those C-clamp units 12 being either of the same size or of different sizes. It is, of course important that the stem size be relatively consistent so that the action of the setting mechanism 14 is still viable.

While in accordance with the patent statutes, the best mode and preferred embodiment of the invention have been described, it is to be understood that the invention is not limited thereto, but rather is to be measured by the scope and spirit of the appended claims.

What is claimed is:

1. An improved C-clamp comprising:

a C-shaped body having an outer leg and an inner leg, a hollow bore passing through said inner leg at a free end thereof;

a smooth stem slidably engaged in the bore and projecting from each end thereof, a first end extending toward said outer leg and a second end extending away from said outer leg;

aligned opposing work-engaging pads on the first end of the stem and the outer leg of the body;

means for releasably holding the stem from rearward movement, mounted at said free end of said inner leg; and a removable setting unit for advancing the stem in the bore toward said outer leg, said setting unit mountable rearwardly of said C-shaped body on said inner leg by means for connecting and removing said setting unit from said C-shaped body.

2. The improved C-clamp according to claim 1 wherein said setting unit comprises an upper portion and a lower portion wherein the lower portion comprises a hand grip and a movable hand lever pivotally associated therewith, the hand grip being integral to the upper portion, the hand lever being movable by one-hand squeezing of the lower portion, and the upper portion further comprising means acting between the upper portion and the stem operative to step-by-step advance the stem in the bore upon recurrent manual squeezing of the lower portion and resultant movement of the hand lever, means to releasably hold the stem in each advanced position thereof, and means for removably mounting the setting unit rearwardly of said C-shaped body.

3. The improved C-clamp of claim 1 wherein both of the second ends of said clevis-shaped lever are smoothly ramped to assist in grasping the pins on the inner leg.

4. The improved C-clamp of claim 1 wherein the clamp unit and the setting unit have mating surfaces correspondingly shaped so that angular rotation of the setting unit about the axis of the stem is minimized when the clamp unit and setting unit are attached to each other.

5. The improved C-clamp of claim 2 wherein the means acting between the upper portion and the stem to step-by-step advance the stem in the bore upon recurrent manual squeezing of the lower portion and resultant movement of the hand lever comprises:

the hand grip, having a box-like structure formed at its upper end with a front and rear wall and a pair of side walls, the front and rear walls each having a co-axial circular aperture therein to accommodate passage of the stem therethrough;

a stiff, normally unloaded, helical spring positioned between the front and rear walls co-axial to the circular apertures therein so that the stem, when passing through the circular apertures, is co-axially around the spring;

at least one advancing lever plate with first and second ends and a circular aperture between the ends, said circular aperture positioned co-axially to the circular apertures in the front and rear walls and sized such that the stem passes in close fit through the aperture when the advancing lever plate is perpendicular to the longitudinal axis of the stem, but the smooth stem is frictionally gripped by the aperture when the advancing lever plate is not perpendicular to said longitudinal axis, said advancing lever plate normally held against the rear wall and perpendicular to the longitudinal axis of the stem by the helical spring, the second end of said advancing lever plate communicated to said hand lever such that squeezing of the setting unit urges the second end of the advancing lever plate forwardly and out of the normal perpendicular relationship to the longitudinal axis of the stem, effectively gripping the smooth stem and urging the stem forwardly, and such that release of the setting unit allows the bias of the spring to slide the advancing lever plate rearwardly in perpendicular relationship to said longitudinal axis for regripping of the smooth stem.

6. The improved C-clamp of claim 5 wherein the means acting between the upper portion and the stem to step-by-step advance the stem in the bore upon recurrent manual squeezing of the lower portion and resultant movement of the hand lever comprises:

a pair of formed plates, the first being relatively long and limber and the second being relatively short and stiff, to drive the stem forward in quick steps when the stem is not encountering resistance and slowly with force when the stem encounters resistance.

7. The improved C-clamp of claim 5 wherein the means acting between the upper portion and the stem to step-by-step advance the stem in the bore upon recurrent manual squeezing of the lower portion and resultant movement of the hand lever comprises:

a short post positioned above and parallel to the axis of the stem and extending through each said advancing lever plate to hold said advancing lever plates in alignment when the stem is not attached to the setting unit.

8. The improved C-clamp of claim 5 wherein the means acting between the upper portion and the stem to step-to-step advance the stem in the bore upon recurrent manual squeezing of the lower portion and resultant movement of the hand lever comprises:

a wall-like structure at the top of the setting unit to closely surround the spring for at least a portion of its length to hold it in position when the stem is not attached to the setting unit.

9. The improved C-clamp of claim 1 wherein the means for releasably holding the stem from rearward movement comprises:

a box-like structure formed at the free end of the inner leg of the C-shaped body with a front and rear wall and a pair of side walls, the front and rear walls each having a co-axial circular aperture therein to accommodate passage of the stem therethrough;

a stiff, normally unloaded, helical spring positioned between said front and rear walls co-axial to the circular apertures therein so that the stem, when passing through the circular apertures, is co-axially around the spring;

a retaining lever plate with first and second ends and a circular aperture between the ends, said circular aperture positioned co-axially to the circular apertures in the front and rear walls and sized such that the stem passes in close fit through the aperture when the retaining lever plate is perpendicular to the longitudinal axis of the stem, but the smooth stem is frictionally gripped by the aperture when the retaining lever plate is not perpendicular to said longitudinal axis, said retaining lever plate normally held against the rear wall and perpendicular to the longitudinal axis of the stem by the helical spring; and a latch lever communicated to the first end of said retaining lever plate such that closing of the latch lever urges the first end of the retaining lever plate forwardly and out of the normal perpendicular relationship to the longitudinal axis of the stem, effectively gripping the smooth stem and retaining it against rearward movement, and such that opening of the latch lever allows the bias of the spring to slide the retaining lever plate rearwardly into perpendicular relationship to said longitudinal axis, effectively releasing the grip upon the smooth stem.

10. The improved C-clamp of claim 1 wherein the means for connecting and removing said setting unit from said C-shaped body comprises:

a clevis-shaped lever having a first end and a bifurcated pair of second ends with an intermediate fulcrum point providing attachment to said setting unit, said first end urged upwardly by a biasing means, said second ends having notches on the lower side thereof for grasping a pair of outwardly-projecting pins on the inner leg of the C-shaped body.

* * * * *